US005376919A

United States Patent [19]

Rickman

[11] Patent Number: 5,376,919

[45] Date of Patent: Dec. 27, 1994

[54] VEHICLE INTRUSION DETECTOR

[75] Inventor: Stephen A. Rickman, Loomis, Calif.

[73] Assignee: C & K Systems, Inc., Folsom, Calif.

[21] Appl. No.: 908,186

[22] Filed: Jul. 1, 1992

[51] Int. Cl.[5] ..... G08B 13/16

[52] U.S. Cl. ..... 340/544; 340/429; 340/522; 340/566

[58] Field of Search ..... 340/544, 566, 521-522, 340/426, 429, 565

[56] References Cited

U.S. PATENT DOCUMENTS 4,853,677 8/1989 Yarbrough et al. ..... 340/544
4,928,085 5/1990 DuRand, III et al. ..... 340/544
4,991,145 2/1991 Goldstein et al. ..... 340/566 X
5,185,593 2/1993 DuRand, III et al. ..... 340/544
5,192,931 3/1993 Smith et al. ..... 340/544 X

*Primary Examiner*—John K. Peng
*Assistant Examiner*—Thomas J. Mullen, Jr.
*Attorney, Agent, or Firm*—Limbach & Limbach

[57] ABSTRACT

A vehicle detector is disclosed wherein either a glass breakage signal or a door opening signal causes an alarm. The glass breakage signal is caused by the detection of high audio frequency simultaneously accompanied by the detection of a positive pressure change. The door opening signal is generated by the detection of a negative pressure change, which is not preceded by a positive pressure change.

19 Claims, 8 Drawing Sheets

VEHICLE INTRUSION DETECTOR

TECHNICAL FIELD

The present invention relates to a detector which generates an alarm in response to the detection of an intrusion into the perimeter of a substantially enclosed space, having a glass portion, such as that of a vehicle. More particularly, the present invention relates to a detector which detects the intrusion in a vehicle from either the breakage of the glass portion or the opening of the door.

BACKGROUND OF THE INVENTION

Detectors to sense the breakage of glass are well known in the art. See, for example, U.S. Pat. No. 4,853,677. While the detector disclosed therein is responsive to high frequency audio sound, such as breakage of glass, as well as low frequency sound, such as the opening of doors and windows, the detector therein cannot discriminate between the opening of a window or the closing of a window. In an automobile, because the volume of air in the interior is trapped, an impact on the window (without breakage thereof) or on the panel lining the interior results in a low frequency audio sound or a pressure wave. Other actions which might produce a low frequency positive pressure wave would be the closing of a door, trunk or hood.

U.S. Pat. No. 4,928,085 discloses a detection device to detect pressure waves at low and infrasonic frequencies. The detected pressure signal is compared to a threshold and an alarm is generated in response thereto. In addition, a combination pressure and sound activated device is also disclosed (see FIG. 4 thereof). A sound discriminator can be used to reduce the incidents of false alarms and glass breakage detectors.

As previously discussed, the detection of intrusion into a vehicle is unique in that the detector must generate an alarm signal in response to the breakage of the glass or of only certain types of pressure changes.

SUMMARY OF THE INVENTION

Therefore, in accordance with the present invention, a detector for generating an alarm signal in response to the detection of an intrusion in the perimeter of a substantially enclosed space such as an automobile is disclosed. The detector comprises means for detecting the breakage of the glass and for generating a breakage signal in response thereto. The detector further comprises means for detecting an instantaneous decrease in air pressure in the space and for generating a negative pressure signal in response thereto. Finally, means for generating the alarm signal is disclosed. The alarm signal is generated in response to either the negative pressure signal or the breakage signal.

DETAILED DESCRIPTION OF THE DRAWINGS

Figure 1:
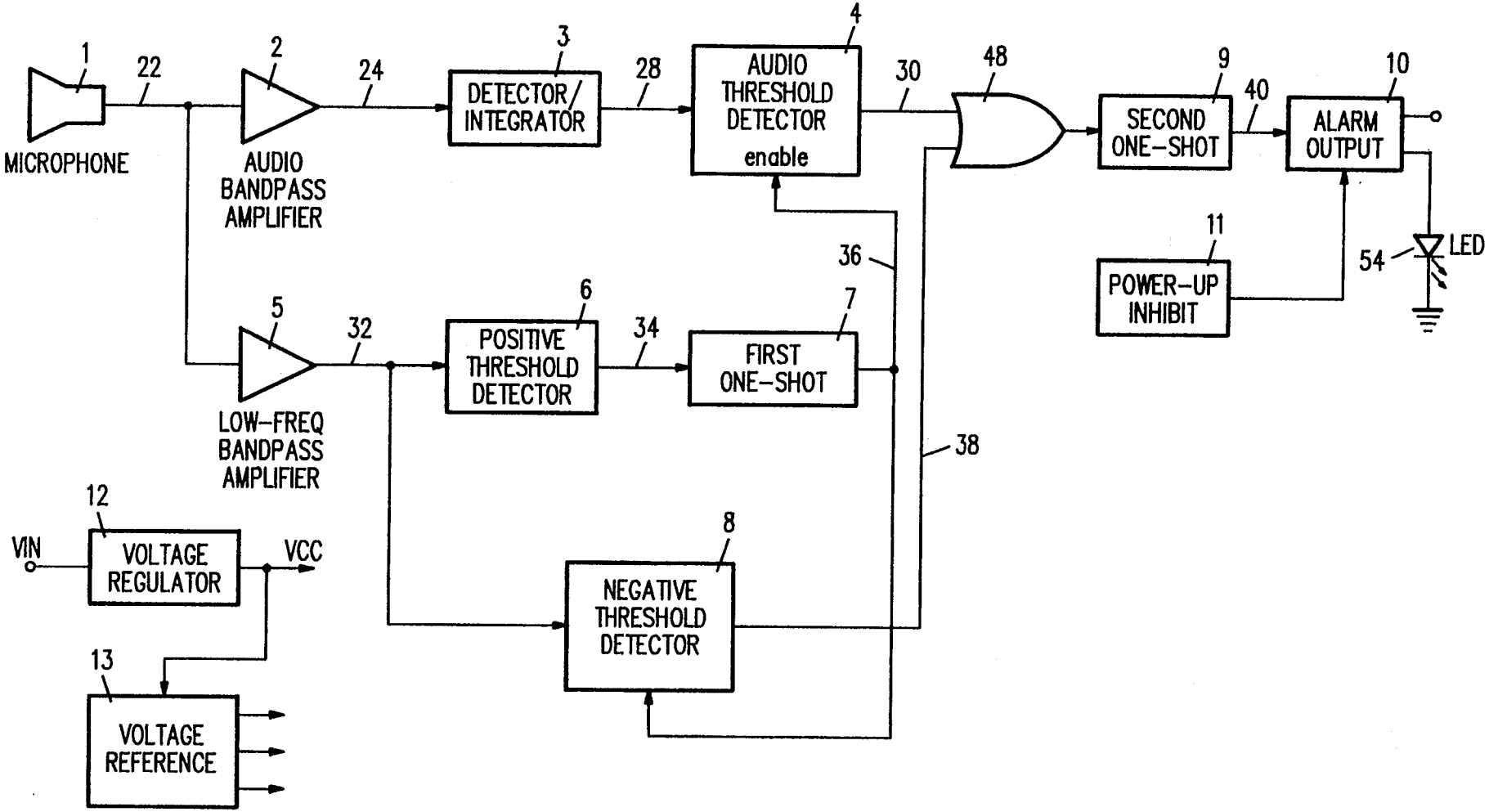
FIG. 1 is a block diagram of the preferred embodiment of the apparatus of the present invention.

Referring to FIG. 1 there is shown a block diagram of a preferred embodiment of a detector 20 of the present invention. The detector 20 comprises a microphone 1. The microphone 1 is an electret condenser type, having good low-frequency response, as defined hereinafter. It can be mounted directly on a printed circuit board. As air pressure increases at the face of the microphone 1, the microphone 1 outputs a voltage increase. The sensitivity of the microphone 1 is approximately −59 dB, where 0 dB is equal to approximately 1 V per microbar. The microphone 1 generates a first signal 22 in response to air pressure or audio sounds.

The first signal 22 is supplied to an audio bandpass amplifier 2. The amplifier 2 receives the first signal 22 and increases the amplitude of the high frequency component, such as those generated by breakage of the glass or the fracturing of tempered and laminated glass. The amplifier 2 consists of two inverting operational amplifiers 23*a* and 23*b* (see FIG. 2) and has a peak gain of approximately 50 dB at approximately 10 kHz. The amplifier 2 has a 3 dB bandwidth which extends from approximately 6 kHz to 17 kHz. A voltage reference $V_b$ biases the amplifier 2 to approximately 2.0 volts. The amplifier 2 generates a second signal 24 at its output.

The second signal 24 is supplied to a detector/integrator 3. The second signal 24 from the amplifier 2 is typically a fast-changing AC signal. The detector/integrator 3 processes the second signal 24 so that it can be tested easily for amplitude and duration. For the second signal 24 having an amplitude above approximately 1 volt peak-to-peak, the detector/integrator 3 charges a capacitor 26 (shown in FIG. 2). This results in a third signal 28, produced as the output of the detector/integrator 3. The third signal 28 has a voltage that steadily decreases from a quiescent value of approximately 5 volts.

The detector/integrator 3 can therefore, be an integrator or sum of the second input signal 24. This provides discrimination against short bursts and noise spikes. The second signal 24 from the amplifier 2 must have a minimum duration of approximately 20 milliseconds in order for the detector/integrator 3 to generate the third signal 28.

The third signal 28 is supplied to an audio threshold detector 4. The audio threshold detector 4 also has an enable port, which receives a seventh signal 36 from a first one-shot 7. When the output of the first one-shot 7 enables the audio threshold detector 4, the audio threshold detector 4 produces a logic compatible trigger fourth signal 30 as its output. The fourth signal 30 is generated when the third signal 28 supplied to the audio threshold detector 4 drops below a preset level of approximately 2.5 volts. The detector 4 is an operational amplifier wired as a comparator. The enable port is a connection to the first one-shot 7 which holds the threshold voltage low until the first one-shot 7 is triggered.

The first signal 22 from the microphone 1 is also supplied to a low-frequency bandpass amplifier 5. The amplifier 5 increases the amplitude of the low frequency signals which are typically produced by pressure waves from door openings and window impacts, as detected by the microphone 1. The low-frequency bandpass amplifier 5 consists of an inverting operational amplifier 25 biased to a quiescent voltage of approximately 2.0 volts. Because the amplifier 5 is inverted, an air pressure increase at the face of the microphone 1 results in a voltage decrease at the output of the amplifier 5. The amplifier 5 has a peak gain of approximately 22 dB at approximately 8 Hz and it has a 3 dB bandwidth of approximately 3.2 Hz. The amplifier 5 is chosen to discriminate against pressure signals originating outside the car, based upon the fact that such signals change more slowly than door signals. The output of the amplifier 5 is a fifth signal 32.

The fifth signal 32 is supplied to a first positive threshold detector 6. The detector 6 generates a sixth signal 34, which is supplied to the first one-shot 7 and is a logic compatible trigger signal therefor. The sixth signal 34 is generated by the detector 6 when the fifth signal 32 supplied thereto crosses a preset threshold of approximately 1.8 volt. This condition corresponds to a moderate air pressure increase at the face of the microphone 1, possibly caused by, for example, an impact on the window. The detector 6 comprises an operational amplifier wired as a comparator.

The first one-shot 7 receives the sixth signal 34. In response to the sixth signal 34, the first one-shot 7 generates a seventh signal 36, which is a pulse signal, of approximately 0.2 second in duration. The seventh signal 36 is supplied to the audio threshold detector 4 to enable the detector 4. In the event the third signal 28 supplied to the audio threshold detector 4 crosses a threshold during the time that the first one-shot 7 generates the seventh signal 36, then a glass breakage event is detected. In short, a glass breakage event occurs when high-frequency audio signal is detected substantially simultaneous with the detection of a positive low-frequency pressure wave. In that event, the fourth signal 30 is generated, signifying an intrusion into the vehicle through the breakage of the glass.

The fifth signal 32 is also supplied to negative threshold detector 8. The negative threshold detector 8 has a sensitivity control port and receives the seventh signal 36. The negative threshold detector 8 is an operation amplifier wired as a comparator. The detector 8 produces an eighth signal 38 which is a logic compatible trigger signal supplied to the OR gate 48 and to the second one-shot 9 when the fifth signal 32 crosses a threshold voltage. The threshold voltage depends upon the state of the first one-shot 7. If the first one-shot 7 is not active, i.e. the seventh signal 36 is not generated, then the threshold voltage is 2.5 volts. With this threshold, the detector 8 is in its most sensitive condition, and it will detect a small negative pressure change at the face of the microphone 1. In this state, a weak door opening can be detected.

If the first one-shot 7 is active, which would be the case if a positive pressure change occurred within the previous 0.2 seconds, then the threshold voltage is 3.2 volts. With this threshold, the detector 8 is much less sensitive and will detect only a large negative pressure change at the face of the microphone 1. In this state, the detector 8 is less likely to be triggered by negative backswings following positive pressure changes.

Figure 2A:
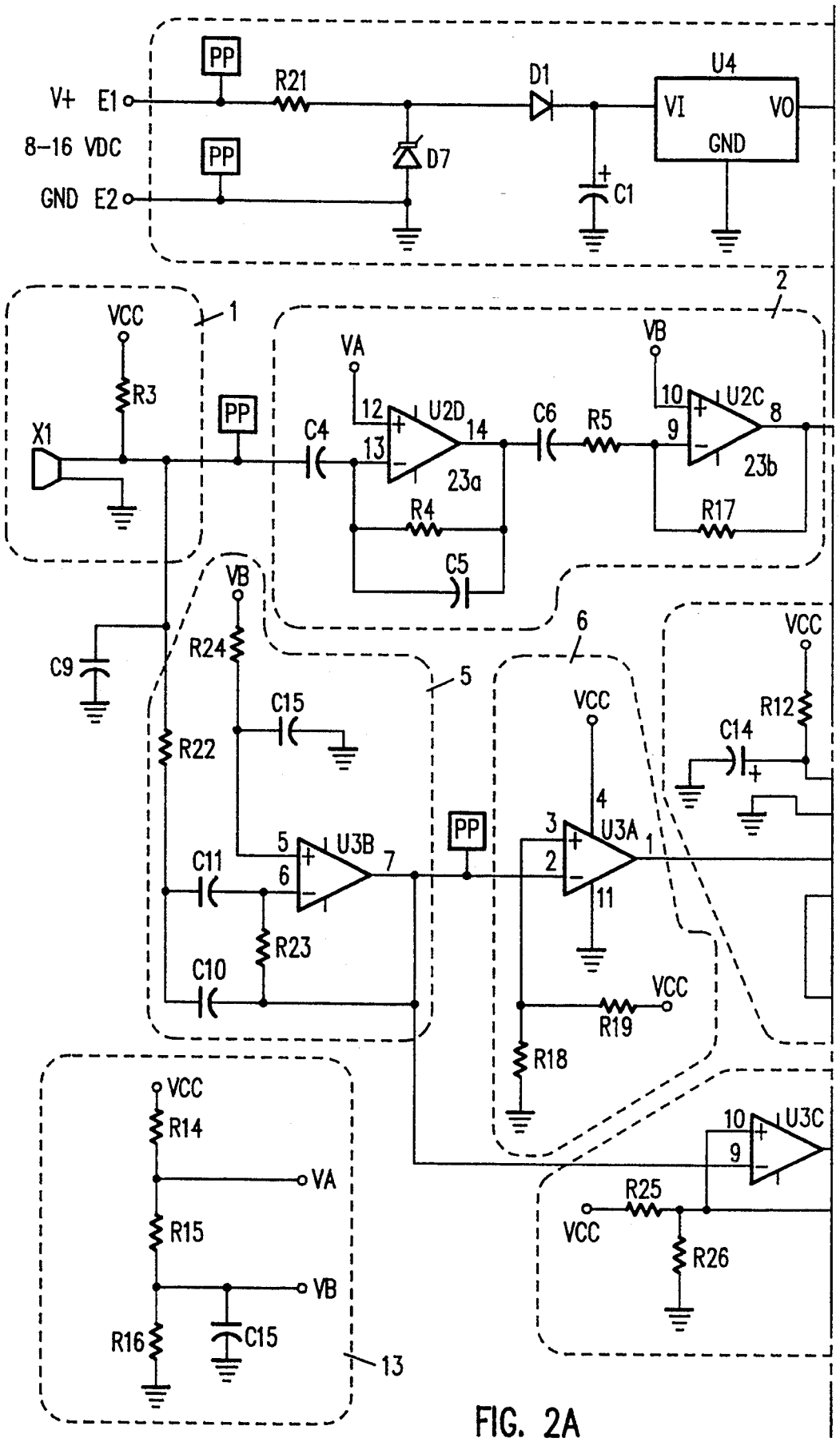
FIG. 2 is a detailed circuit diagram of the embodiment shown in FIG. 1.
Figure 2B:
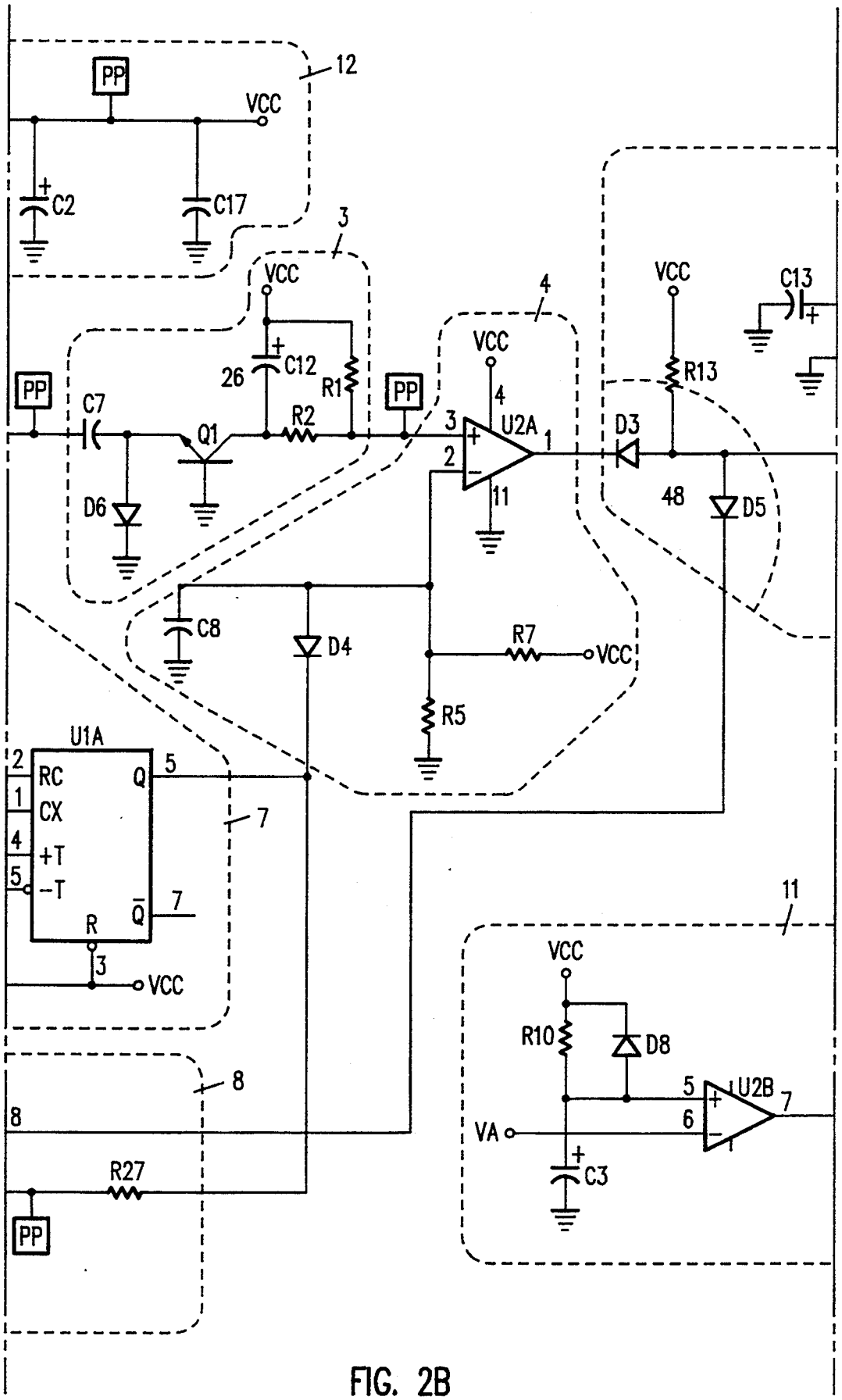
Figure 2C:
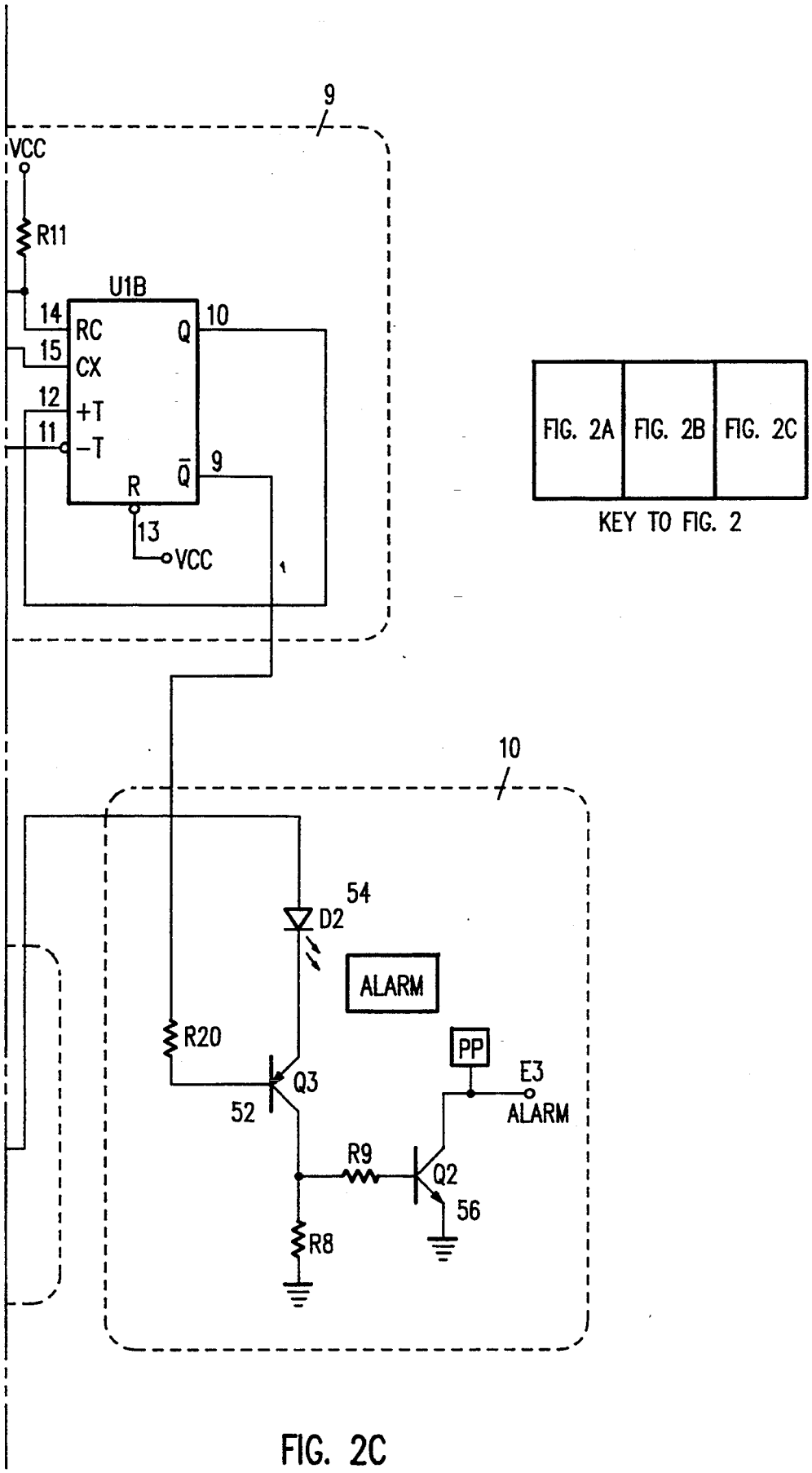

The fourth signal 30 and the eighth signal 38 are supplied to an OR gate 48, which are hardwire connected through two steering diodes and a pull-up resistor (shown in FIG. 2). The output of the OR gate 48 is supplied to a second one-shot 9. Although the fourth signal 30 and the eighth signal 38 are shown as being supplied to an OR gate 48, schematically, in FIG. 1, as can be seen in FIG. 2, circuit wise, the OR gate 48 is a portion of the second one-shot 9.

The second one-shot 9 generates an active-low pulse of approximately 4 seconds duration upon the presence of either the fourth signal 30 or the eighth signal 38. The active-low pulse of approximately 4 seconds is a ninth signal 40.

The ninth signal 40 is supplied to an alarm output 10. This circuit provides an alarm-system compatible output and has a visual indicator, such as an LED 54 to indicate an alarm status. If the alarm output 10 is enabled by the power-up inhibit 11, an active low pulse from the second one-shot 9 turns on a PNP transistor 52. The PNP transistor 52 draws current through the LED 54 for a visual indication of an alarm. The PNP transistor 52 also turns on an NPN transistor 56 which has an uncommitted collector terminal. This uncommitted collector terminal is the final output for the apparatus 20. Normally, it will be connected through a resistor to a logic supply voltage in the alarm system control circuit. When the alarm output is active, the voltage at the uncommitted collector will be pulled down to a logic low level.

The power-up inhibit circuit 11 insures that the apparatus 20 will not generate a false alarm when power is initially applied. The circuit is a comparator which provides the supply voltage to the alarm output 10. When power is supplied, the output remains near 0 volts for a period of approximately 5 seconds, which is longer than the output pulse duration of the second one-shot 9. During this time, the alarm output cannot become active even if the second one-shot 9 generates a ninth signal 40.

The apparatus 20 also comprises a voltage regulator 12. This circuit accepts eight to sixteen volts unregulated DC power from the alarm control system and supplies regulated 5 volts to the various circuit components in the apparatus 20. At the input, a series rectifier diode provides reverse polarity protection and a Tranzorb 60 provides protection against surges and transients.

The apparatus 20 also comprise a voltage reference circuit 13. This is a simple resistor ladder which provides reference voltage to the amplifiers and comparators in the apparatus 20. The regulator integrated circuit in the voltage regulator 12 is a high accuracy type allowing it to be used as a voltage source for this circuit.

Figure 3:
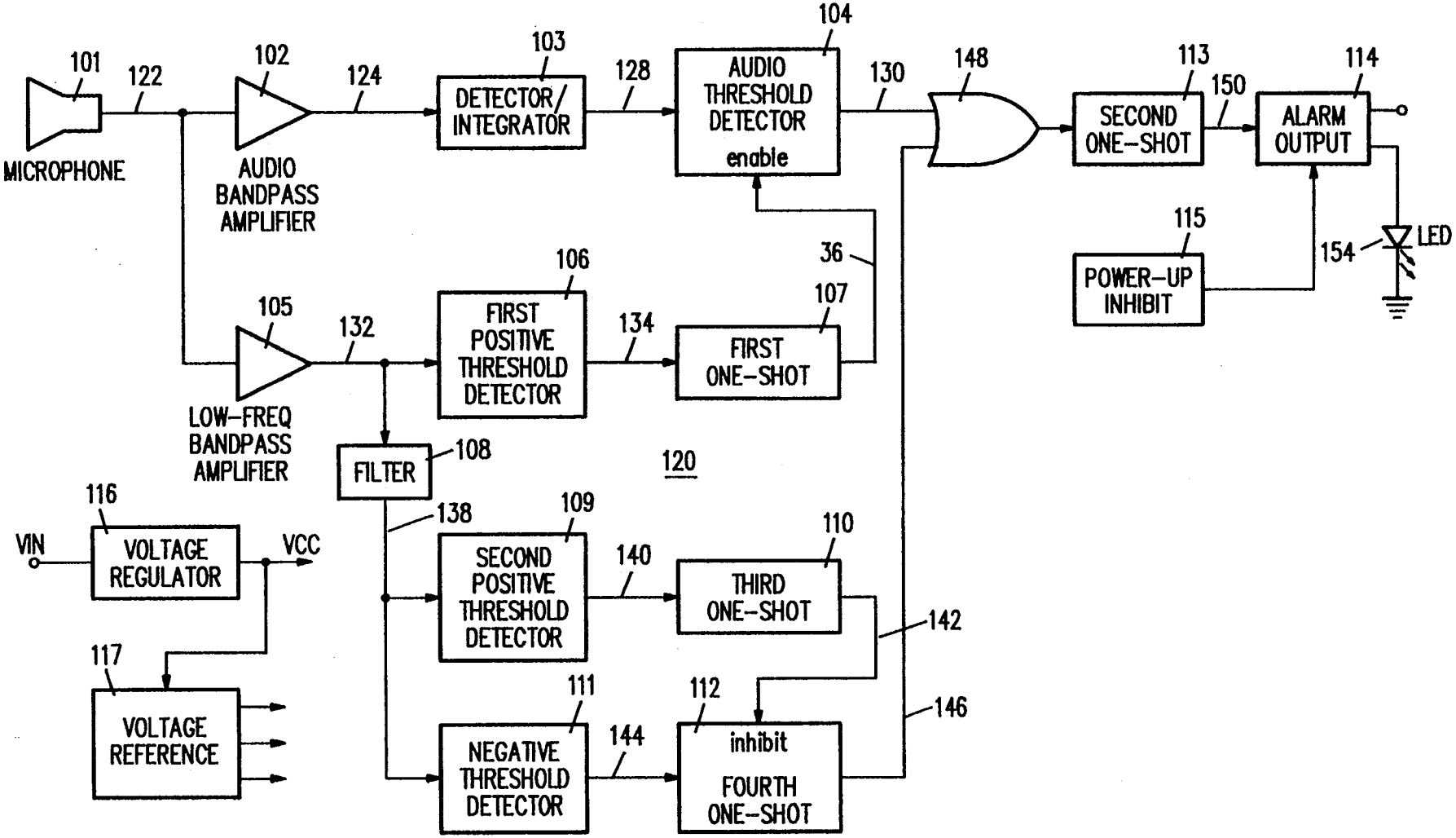
FIG. 3 is a block diagram of another embodiment of the present invention.

Referring to FIG. 3 there is shown a block diagram of another embodiment of a detector 120 of the present invention. The detector 120 comprises a microphone 101. The microphone 101 is an electret condenser type, having good low-frequency response, as defined hereinafter. It can be mounted directly on a printed circuit board. As air pressure increases at the face of the microphone 101, the microphone 101 outputs a voltage increase. The sensitivity of the microphone 101 is approximately −59 dB, where 0 dB is equal to approximately 1 V per microbar. The microphone 101 generates a first signal 122 in response to air pressure or audio sounds.

The first signal 122 is supplied to an audio bandpass amplifier 102. The amplifier 102 receives the first signal 122 and increases the amplitude of the high frequency component, such as those generated by breakage of the glass or the fracturing of tempered and laminated glass. The amplifier 102 consists of two inverting operational amplifiers **123*a* and 123*b* (see FIG. 4) and has a peak gain of approximately 50 dB at approximately 10 kHz. The amplifier 102 has a 3 dB bandwidth which extends from approximately 6 kHz to 17 kHz. A voltage reference $V_b$ biases the amplifier 102 to approximately 2.0 volts. The amplifier 102 generates a second signal 124** at its output.

The second signal 124 is supplied to a detector/integrator 103. The second signal 124 from the amplifier 102 is typically a fast-changing AC signal. The detector/integrator 103 processes the second signal 124 so that it can be tested easily for amplitude and duration. For the second signal 124 having an amplitude above approximately 1 volt peak-to-peak, the detector/integrator 103 charges a capacitor 126 (shown in FIG. 4). This results in a third signal 128, produced as the output of the detector/integrator 103. The third signal 128 has a voltage that steadily decreases from a quiescent value of approximately 5 volts.

The detector/integrator 103 can therefore, be an integrator or sum of the second input signal 124. This provides discrimination against short bursts and noise spikes. The second signal 124 from the amplifier 102 must have a minimum duration of approximately 20 milliseconds in order for the detector/integrator 103 to generate a third signal 128.

The third signal 128 is supplied to an audio threshold detector 104. The audio threshold detector 104 also has an enable port, which receives a seventh signal 136 from a first one-shot 107. When the output of the first one-shot 107 enables the audio threshold detector 104, the audio threshold detector 104 produces a logic compatible trigger fourth signal 130 as its output. The fourth signal 130 is generated when the third signal 128 supplied to the audio threshold detector 104 drops below a preset level of approximately 2.5 volts. The detector 104 is an operational amplifier wired as a comparator. To prevent possible timing problems, the threshold voltage to the comparator is derived from the output of the second one-shot 113 (shown in greater detail in FIG. 4). As previously stated, the enable port is a connection to the first one-shot 107 which holds the threshold voltage low until the first one-shot 107 is triggered.

The first signal 122 from the microphone 101 is also supplied to a low-frequency bandpass amplifier 105. The amplifier 105 increases the amplitude of the low frequency signals which are typically produced by pressure waves from door openings and window impacts, as detected by the microphone 101. The low-frequency bandpass amplifier 105 consists of an inverting operational amplifier 125 biased to a quiescent voltage of approximately 2.0 volts. Because the amplifier 105 is inverted, an air pressure increase at the face of the microphone 101 results in a voltage decrease at the output of the amplifier 105. The amplifier 105 has a peak gain of approximately 32 dB at approximately 10 Hz and it has a 3 dB bandwidth extending from approximately 3 Hz to 30 Hz. The output of the amplifier 105 is a fifth signal 132.

The fifth signal 132 is supplied to a first positive threshold detector 106. The detector 106 generates a sixth signal 134, which is supplied to the first one-shot 107. The sixth signal 134 is generated by the detector 106 when the fifth signal 132 supplied thereto crosses a preset threshold of approximately 1 volt. This condition corresponds to a large air pressure increase at the face of the microphone 101, caused by, for example, an impact on the window. The detector 106 comprises an operational amplifier wired as a comparator. Again, to prevent possible timing problems, the threshold voltage is derived from the first one-shot 107.

The first one-shot 107 receives the sixth signal 134. In response to the sixth signal 134, the first one-shot 7 generates a seventh signal 136, which is a pulse signal, of approximately 0.4 second in duration. The seventh signal 136 is supplied to the audio threshold detector 104 to enable the detector 104. The one-shot 107 is a logic flip-flop wired as a one-shot. Feedback from the one-shot 107 controls the threshold voltage of the first positive threshold detector 106 to prevent timing problems. In the event the third signal 128 supplied to the audio threshold detector 104 crosses a threshold during the time that the first one-shot 107 generates the seventh signal 136, then a glass breakage event is detected. In short, a glass breakage event occurs when high-frequency audio signal is detected substantially simultaneous with the detection of a positive low-frequency pressure wave. In that event, the fourth signal 130 is generated, signifying an intrusion into the vehicle through the breakage of the glass.

The fifth signal 132 is also supplied to a filter 108. The filter 108 is a low pass R-C circuit which provides a low-frequency eighth signal 138 as its output.

The eighth signal 138 is supplied to a second positive threshold detector 109. The second positive threshold detector 109 generates a ninth signal 140 as its output when the eighth signal 138 supplied thereto crosses a preset threshold of approximately 1.0 volt. The eighth signal 138 crosses a preset threshold of approximately 1.0 volt when a large air pressure increase at the face of the microphone 101 occurs. The second positive threshold detector 109 operates as an operational amplifier wired as a comparator.

The ninth signal 140 is supplied to a third one-shot 110. The third one-shot 110 generates a tenth signal 142 which is a pulse of approximately 0.1 second in duration. The tenth signal 142 is generated whenever a large air pressure increase occurs at the face of the microphone 101, causing the generation of the eighth signal 138 which has a magnitude greater than the preset threshold of approximately 1.0 volt. This causes the generation of the ninth signal 140. The tenth signal 142 is supplied to a fourth one-shot 112 at its inhibit input thereof. The tenth signal 142 is generated on the trailing edge of the trigger from the second positive threshold detector 109, insuring that the inhibit period will start as soon as pressure begins to change in the opposite or in the decreasing direction. The third one-shot 110 is retriggerable meaning that the tenth signal 142 will be generated if a new ninth signal 140 is supplied thereto while the third one-shot 110 is still active. This insures that for large signals swinging between positive and negative, no inhibit dropout will occur.

The eighth signal 138 is also supplied to a negative threshold detector 111. The negative threshold detector 111 generates a logic compatible trigger eleventh signal 144, when the eighth signal 138 crosses a preset threshold of approximately 3.2 volts. This condition occurs for a large air pressure decrease at the face of the microphone 101. The negative threshold detector 111 is an operational amplifier wired as a comparator.

The eleventh signal 144 is supplied to a fourth one-shot 112. The fourth one-shot 112, if it is not inhibited by the tenth signal 142 from the third one-shot 110, will generate a twelfth signal 146 as its output. The twelfth signal 146 would be a pulse of approximately 1 millisecond duration. The fourth one-shot 112 generates the twelfth signal 146 whenever a large negative pressure change, not immediately preceded by a large positive pressure change, occurs at the face of the microphone 101. This corresponds to the condition of detection of an instantaneous decreasing pressure, such as a door opening in a vehicle. The inhibit input to the fourth one-shot 112 is simply the reset input to the fourth one-shot 112.

Thus, the apparatus 120 generates a negative pressure signal 146 if a negative pressure signal 144 is detected and is not immediately preceded by the detection of a positive pressure signal 142.

Figure 4A:
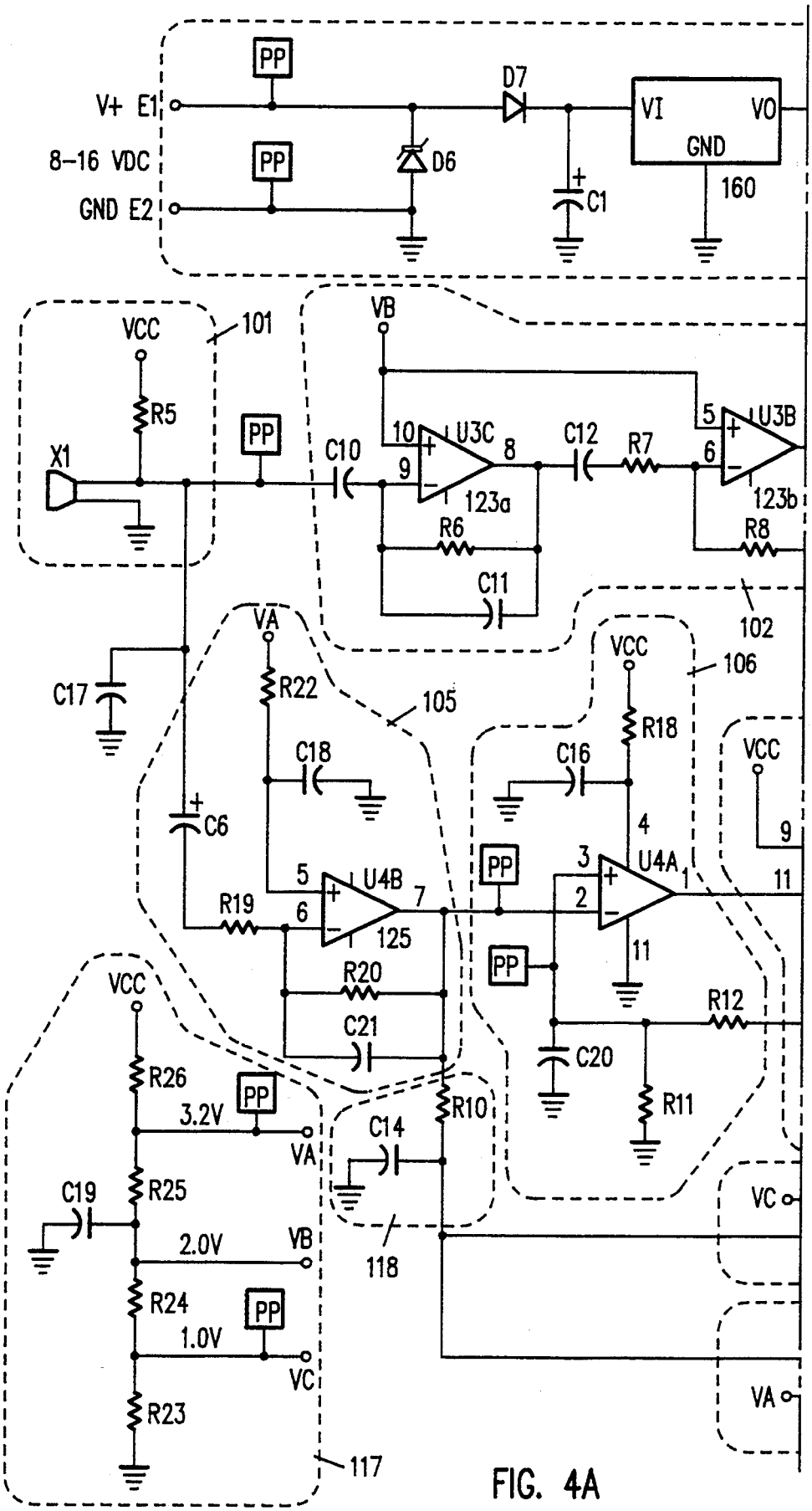
FIG. 4 is a detailed circuit diagram of the embodiment shown in FIG. 3.
Figure 4B:
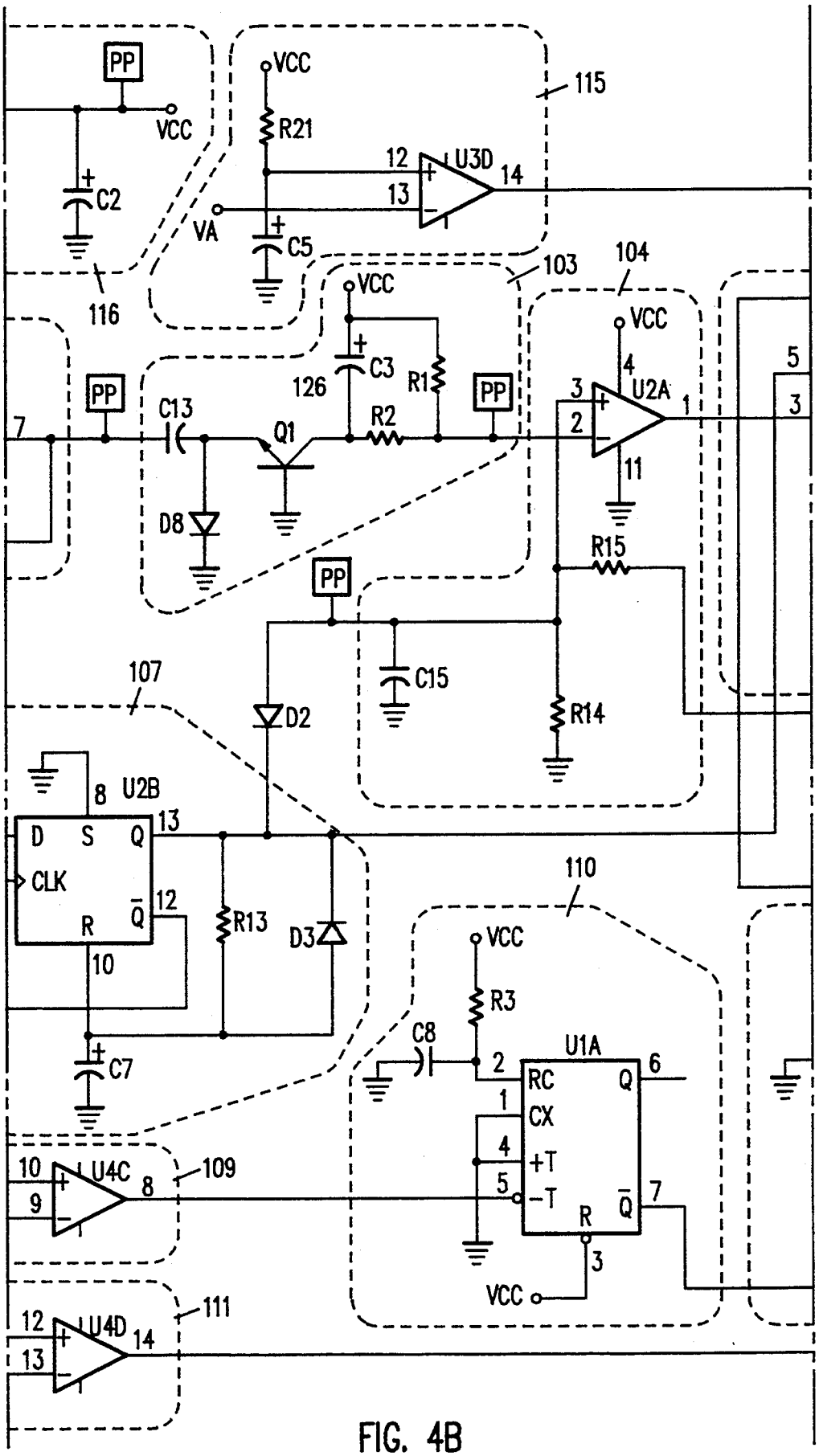
Figure 4C:
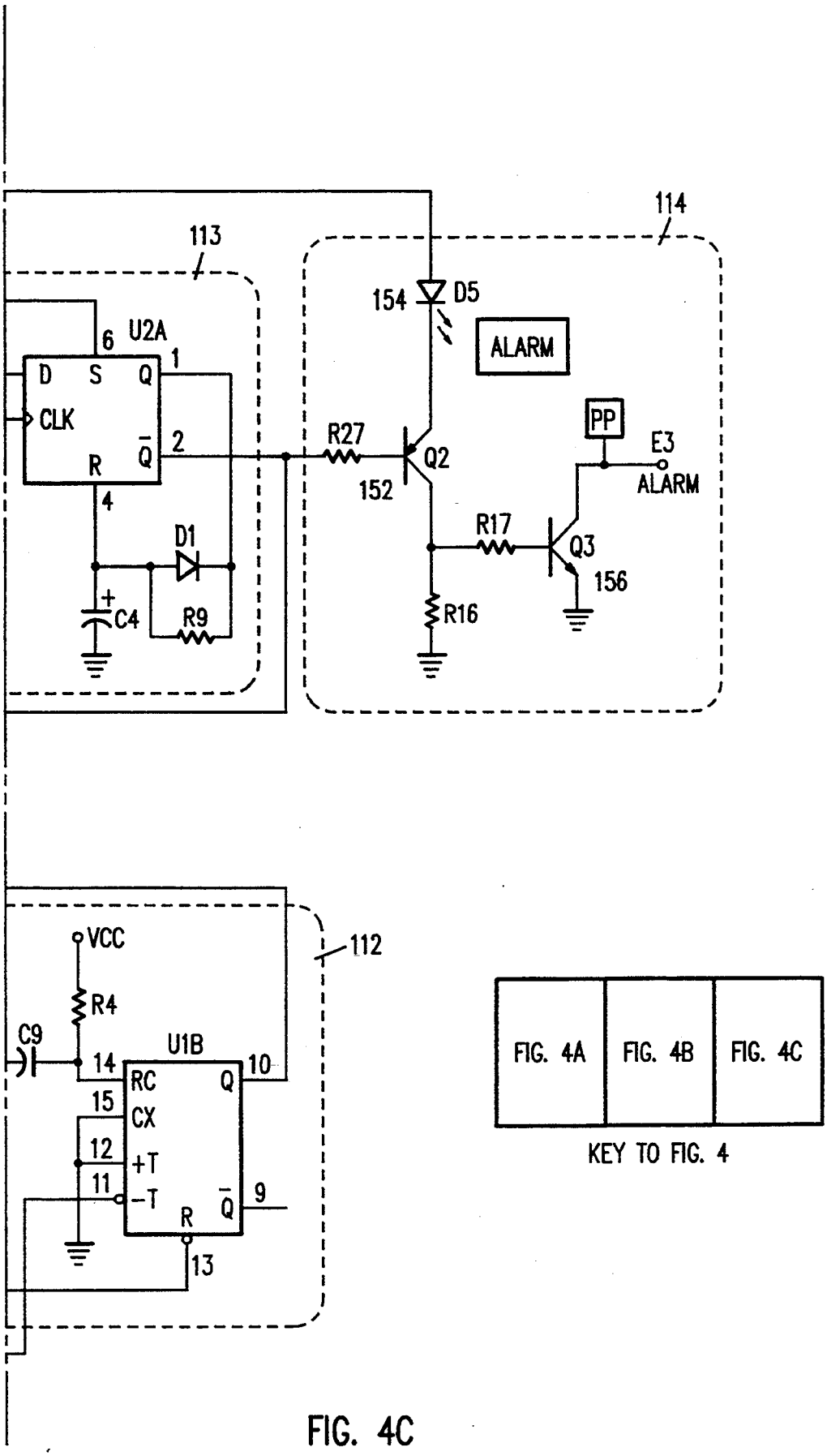

The fourth signal 130 and the twelfth signal 146 are supplied to an OR gate 148. The output of the OR gate 148 is supplied to a second one-shot 113. Although the fourth signal 130 and the twelfth signal 146 are shown as being supplied to an OR gate 148, schematically, in FIG. 3, as can be seen in FIG. 4, circuit wise, the OR gate 148 is a portion of the second one-shot 113.

The second one-shot 113 comprises a one-shot to which the fourth signal 130 from the output of the audio threshold detector 104 is supplied at its clock input. The twelfth signal 146 from the fourth one-shot 112 is supplied to the set input of the one-shot 113. The second one-shot 113 generates an active-low pulse of approximately 4 second duration upon the presence of either the fourth signal 130 or the twelfth signal 146. The active-low pulse of approximately 4 seconds is a thirteenth signal 150. The second one-shot 113 is a logic flip-flop wired as a one-shot.

The thirteenth signal 150 is supplied to an alarm output 114. This circuit provides an alarm-system compatible output and has a visual indicator, such as an LED 154 to indicate an alarm status. If the alarm output 114 is enabled by the power-up inhibit 115, an active low pulse from the second one-shot 113 turns on a PNP transistor 152. The PNP transistor 152 draws current through the LED 154 for a visual indication of an alarm. The PNP transistor 152 also turns on an NPN transistor 156 which has an uncommitted collector terminal. This uncommitted collector terminal is the final output for the apparatus 120. Normally, it will be connected through a resistor to a logic supply voltage in the alarm system control circuit. When the alarm output is active, the voltage at the uncommitted collector will be pulled down to a logic low level.

The power-up inhibit circuit 115 insures that the apparatus 120 will not generate a false alarm when power is initially applied. The circuit is a comparator which provides the supply voltage to the alarm output 114. When power is supplied, the output remains near 0 volts for a period of approximately 5 seconds, which is longer than the output pulse duration of the second one-shot 113. During this time, the alarm output cannot become active even if the second one-shot 113 generates a thirteenth signal 150.

The apparatus 120 also comprises a voltage regulator 116. This circuit accepts eight to sixteen volts unregulated DC power from the alarm control system and supplies regulated 5 volts to the various circuit components in the apparatus 120. At the input, a series rectifier diode provides reverse polarity protection and a Tranzorb 160 provides protection against surges and transients.

The apparatus 120 also comprise a voltage reference circuit 117. This is a simple resistor ladder which provides reference voltage to the amplifiers and comparators in the apparatus 120. The regulator integrated circuit in the voltage regulator 116 is a high accuracy type allowing it to be used as a voltage source for this circuit.

THEORY OF OPERATION

Because the volume of air in the interior of a vehicle which is substantially closed, is trapped, any impact on the window or on the panels lining the interior results in a relatively large amplitude pressure wave, as well as sound wave. By pressure wave, it is meant acoustic waves which are too low in frequency to be detected by the human ear. The instantaneous polarity of the pressure waves is sensed by the microphone.

Any impact on the windows or on the panels from outside of the car causes a pressure wave that is initially positive in polarity. Pressure at the inside surface of the window momentarily increases as the window of the panel flexes inward. As the window or the panel rebounds pressure then decreases and changes polarity as the window expands. This is followed by alternative pressure changes as the window vibrates back and forth, with diminishing amplitude. This analysis is also true for impacts on panels lining the interior such as the roof of the car.

On the other hand, however, detection of intrusion by a door opening requires detection of pressure change in the inside surface that is initially or instantaneously decreasing. The pressure decrease is followed by an in-rush of air from the outside of the car acting to equalize the pressure differential. Since air has mass and compliance or springiness and because windows and panels of the car are elastic, the apparatus may not equalize in a single step and thus a number of alternating pressure changes may occur as air oscillates between the interior and the exterior.

For the microphone placed inside the car, both window impacts and door openings are sensed as an initial large amplitude pressure change followed by one or more pressure changes of alternating polarity. However, the polarity for these two different events are different. For window impacts, the initial pressure change is increasing whereas for door openings, the initial pressure change is decreasing.

For detection of door openings, it is necessary to sense initially a decreasing large amplitude pressure change. Whereas for glass breakage detection, the microphone must sense an initial increasing pressure change accompanied by high-frequency audio caused by the fracturing of the glass.

For a door opening signal, the detection is made either by a decreasing pressure threshold detector whose threshold is not increased (or not following the detection of a increasing pressure change) as shown in FIGS. 1 and 2 or by a decreasing pressure threshold detector whose signal is not inhibited after the detection of a increasing pressure change signal, as shown in FIGS. 3 and 4. The problem with the apparatus 120 wherein the signal from the decreasing pressure threshold detector is inhibited is that it is possible to mask a door opening signal by striking a window immediately before opening the door. By only desensitizing the threshold (as in the circuit 20 shown in FIGS. 1 and 2), the decreasing pressure detector would still detect normal door openings.

As can be seen from the foregoing, a detector to detect the intrusion into the perimeter of an enclosed space such as a vehicle, caused by intrusion of either a door opening or glass breakage is disclosed.

What is claimed is:

1. A detector for generating an alarm signal in response to the detection of an intrusion in the perimeter of a space substantially enclosed and having a glass portion, said detector comprising:

means for detecting a positive air compression wave in said space and for generating an enable signal in response thereto;

means for detecting the breakage of said glass portion and for generating a breakage signal;

means for detecting a negative air compression wave in said space and for generating a negative pressure signal in response thereto;

comparator means for receiving said enable signal and for generating a threshold signal and for receiving said negative pressure signal and for comparing said negative pressure signal to said threshold signal and for generating an instantaneous negative pressure signal in response thereto; and means for generating an alarm signal in response to the generation of either said instantaneous negative pressure signal or said breakage signal.

2. The detector of claim 1 wherein said means for generating said breakage signal receives said enable signal and generates said breakage signal in response to the presence of said enable signal and to the breakage of said glass portion.

3. The detector of claim 1 wherein said enclosed space is a vehicle.

4. The detector of claim 1 wherein said means for detecting the breakage of said glass portion comprises:

second means for detecting a positive air compression wave in said space and for generating an enable signal in response thereto;

means for detecting an audio sound in said space and for generating an audio signal in response thereto;

means for receiving said audio signal and said enable signal and for generating said breakage signal in response to presence of both of said audio signal and said enable signal.

5. The detector of claim 4 wherein said second means for detecting a positive air compression wave generates said enable signal in response to a signal exceeding a preset threshold.

6. The detector of claim 4 wherein said receiving means generates said breakage signal in response to said audio signal exceeding a preset threshold and in the presence of said enable signal.

7. A detector for generating an alarm signal in response to the detection of an intrusion in the perimeter of a space substantially enclosed and having a glass portion, said detector comprising:

means for detecting a positive air compression wave in said space and for generating an inhibit signal in response thereto;

means for detecting the breakage of said glass portion and for generating a breakage signal;

means for detecting a negative air compression wave in said space and for generating a negative pressure threshold signal in response thereto;

means for receiving said negative pressure threshold signal and said inhibit signal and for generating an instantaneous negative pressure signal in response to said negative pressure threshold signal in the absence of said inhibit signal; and, means for generating an alarm signal in response to the generation of either said instantaneous negative pressure signal or said breakage signal.

8. The detector of claim 7 wherein said means for detecting a positive air compression wave generates said inhibit signal in response to a signal exceeding a preset threshold.

9. The detector of claim 7 wherein said means for detecting a negative air compression wave generates said negative pressure threshold signal in response to a signal exceeding a preset threshold.

10. The detector of claim 7 wherein said space is a vehicle.

11. An intrusion detector for generating an alarm in response to the detection of an intrusion in the perimeter of a vehicle substantially enclosed and having a glass portion, said detector comprising:

means for detecting a positive air compression wave in said vehicle and for generating an enable signal in response thereto;

means for detecting the breakage of said glass portion and for receiving said enable signal and for generating a breakage signal in response to said breakage of said glass portion and the presence of said enable signal;

means for detecting a negative air compression wave in said vehicle and for generating an initial negative pressure signal in response to the absence of said enable signal and the detection of said negative air compression wave; and means for generating an alarm signal in response to the generation of either said initial negative pressure signal or said breakage signal.

12. A detector for generating an alarm in response to the detection of an intrusion in the perimeter of a space substantially enclosed, said detector comprising:

microphone means for generating a first signal in response to the detection of acoustic waves in said space, said acoustic waves representative of change in air pressure or presence of audio sound in said space;

first circuit means for receiving said first signal and for generating a breakage signal, said breakage signal representative of the detection of audio sound by said microphone means;

low frequency filter means for receiving said first signal and for producing a low frequency signal in response thereto;

positive threshold detection circuit means for receiving said low frequency signal and for generating an enable signal in response to said low frequency signal exceeding a positive threshold;

negative threshold detection circuit means for receiving said low frequency signal and said enable signal and for generating an instantaneous negative pressure signal in response to said low frequency signal exceeding a negative threshold signal; wherein said negative threshold detection circuit means increases said negative threshold signal in response to the presence of said enable signal; and means for generating an alarm signal in response to the generation of either said initial negative pressure signal or said breakage signal.

13. The detector of claim 12 wherein said first circuit means also receives said enable signal and generates said breakage signal in response to the presence of said enable signal and said first signal.

14. A intrusion detector for generating an alarm in response to the detection of an intrusion in the perimeter of a vehicle substantially enclosed and having a glass portion and an ambient air pressure, said detector comprising:

means for detecting the breakage of said glass portion and for generating a breakage signal;

means for detecting an air pressure in said vehicle greater than said ambient air pressure and for generating an inhibit signal in response thereto;

means for receiving said inhibit signal, and for detecting an air pressure in said vehicle less than said ambient air pressure and for generating a negative pressure signal in response to the absence of said inhibit signal and the detection of air pressure less than said ambient air pressure; and means for generating an alarm signal in response to either said negative pressure signal or said breakage signal.

15. The detector of claim 14 wherein said means for detecting an air pressure greater than said ambient air pressure generates said inhibit signal in response to a signal exceeding a preset threshold.

16. The detector of claim 14 wherein said means for detecting an air pressure less than said ambient air pressure generates said negative pressure signal in response to a signal exceeding a preset threshold.

17. The detector of claim 14 wherein said means for detecting the breakage of said glass portion comprises:

second means for detecting an air pressure in said vehicle greater than said ambient air pressure and for generating an enable signal in response thereto;

means for detecting an audio sound in said vehicle and for generating an audio signal in response thereto;

means for receiving said audio signal and said enable signal and for generating said breakage signal in response to presence of both of said audio signal and said enable signal.

18. The detector of claim 17 wherein said second means for detecting an air pressure greater than said ambient air pressure generates said enable signal in response to a signal exceeding a preset threshold.

19. The detector of claim 17 wherein said receiving means generates said breakage signal in response to said audio signal exceeding a preset threshold and in the presence of said enable signal.

* * * * *